US011118817B2

(12) United States Patent
Zha

(10) Patent No.: US 11,118,817 B2
(45) Date of Patent: Sep. 14, 2021

(54) COOLING SYSTEM

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 172 days.

(21) Appl. No.: 15/944,142

(22) Filed: Apr. 3, 2018

(65) Prior Publication Data

US 2019/0301772 A1 Oct. 3, 2019

(51) Int. Cl.
*F25B 1/10* (2006.01)
*F25B 9/10* (2006.01)
(Continued)

(52) U.S. Cl.
CPC ..... *F25B 1/10* (2013.01); *F25B 9/10* (2013.01); *F25B 39/02* (2013.01); *F25B 40/04* (2013.01); *F25B 41/20* (2021.01); *F25B 43/006* (2013.01); *F25B 49/005* (2013.01); *F25B 5/02* (2013.01); *F25B 7/00* (2013.01); *F25B 41/40* (2021.01); *F25B 2339/024* (2013.01);
(Continued)

(58) Field of Classification Search
CPC ..... F25B 1/10; F25B 9/10; F25B 5/02; F25B 40/04; F25B 41/04; F25B 41/043; F25B 41/003; F25B 43/006; F25B 2400/0409; F25B 2400/0401; F25B 2400/053; F25B 2400/0415; F25B 2500/07
See application file for complete search history.

(56) References Cited

U.S. PATENT DOCUMENTS 3,078,689 A * 2/1963 Japhet ..... F25B 6/02 62/324.3
3,105,365 A * 10/1963 Harris et al. ..... F25B 13/00 62/159
(Continued)

FOREIGN PATENT DOCUMENTS

EP 3139111 A1 3/2017
JP 5921718 B2 * 5/2016 ..... F25B 7/00
(Continued)

OTHER PUBLICATIONS

European Patent Office, Extended European Search Report, Application No. 19163708.1, dated Sep. 3, 2019, 5 pages.

*Primary Examiner* — Jianying C Atkisson
*Assistant Examiner* — Miguel A Diaz
(74) *Attorney, Agent, or Firm* — Baker Botts L.L.P.

(57) ABSTRACT

An apparatus includes a high side heat exchanger, a flash tank, a first load, a first compressor, an auxiliary cooling system, and a first check valve. The high side heat exchanger removes heat from a refrigerant. The flash tank stores the refrigerant from the high side heat exchanger. The first load uses the refrigerant to remove heat from a space proximate the first load. The first compressor compresses the refrigerant from the first load. The auxiliary cooling system removes heat from the refrigerant stored in the flash tank during a power outage. The first check valve directs the refrigerant between the first load and the first compressor back to the flash tank when the pressure of the refrigerant between the first load and the first compressor exceeds a threshold during the power outage.

21 Claims, 3 Drawing Sheets

(51) Int. Cl.

| | |
|---|---|
| ***F25B 39/02*** | (2006.01) |
| ***F25B 43/00*** | (2006.01) |
| ***F25B 41/20*** | (2021.01) |
| ***F25B 41/40*** | (2021.01) |
| ***F25B 40/04*** | (2006.01) |
| ***F25B 49/00*** | (2006.01) |
| *F28D 21/00* | (2006.01) |
| *F25B 5/02* | (2006.01) |
| *F25B 7/00* | (2006.01) |

(52) U.S. Cl.

CPC ... *F25B 2400/0409* (2013.01); *F25B 2400/05* (2013.01); *F25B 2400/072* (2013.01); *F25B 2400/13* (2013.01); *F25B 2400/23* (2013.01); *F25B 2500/06* (2013.01); *F25B 2500/07* (2013.01); *F25B 2500/29* (2013.01); *F28D 2021/0071* (2013.01)

(56) References Cited

U.S. PATENT DOCUMENTS 3,234,752 A * 2/1966 Quick ..... F25B 40/04 62/192
4,184,341 A * 1/1980 Friedman ..... F25B 5/02 236/1 EA
4,621,505 A * 11/1986 Ares ..... F25B 5/02 62/196.4
4,899,555 A * 2/1990 Shaw ..... F25B 5/04 62/505
6,006,532 A * 12/1999 Suzuki ..... B60H 1/3225 62/225
7,275,385 B2 * 10/2007 Abel ..... F25B 13/00 62/324.4
8,037,710 B2 * 10/2011 Wu ..... F25B 1/04 62/324.6
8,695,369 B2 * 4/2014 Wu ..... F25B 13/00 62/324.6
9,709,302 B2 * 7/2017 Martin ..... F25B 15/006
10,088,202 B2 * 10/2018 Huff ..... B60H 1/3232
10,365,023 B2 * 7/2019 Zha ..... F25B 49/02
2003/0024262 A1 * 2/2003 Mosemann ..... F25B 1/047 62/335
2005/0011221 A1 * 1/2005 Hirota ..... F25B 49/022 62/500
2005/0262870 A1 * 12/2005 Narayanamurthy .. F24F 5/0017 62/434
2007/0039336 A1 * 2/2007 Wu ..... F25B 13/00 62/160
2007/0039347 A1 * 2/2007 Robertson Abel ..... F25B 41/20 62/324.1
2008/0110200 A1 * 5/2008 Javerschek ..... F25B 9/008 62/515
2008/0196420 A1 * 8/2008 Gernemann ..... F25B 9/008 62/117
2010/0229582 A1 * 9/2010 Yamada ..... F25B 1/10 62/238.7
2012/0023976 A1 * 2/2012 Kim ..... F24F 11/62 62/89
2012/0167601 A1 * 7/2012 Cogswell ..... F25B 1/10 62/115
2013/0145791 A1 * 6/2013 Christensen ..... F25B 1/10 62/498
2014/0208785 A1 * 7/2014 Wallace ..... F25B 9/008 62/115
2014/0326018 A1 * 11/2014 Ignatiev ..... F25B 49/02 62/510
2014/0352343 A1 * 12/2014 Hinde ..... F25B 1/10 62/277
2015/0345835 A1 * 12/2015 Martin ..... F25B 7/00 62/238.3
2016/0178244 A1 * 6/2016 DelVentura ..... F25B 7/00 62/113
2016/0231063 A1 * 8/2016 Zimmermann ..... F28D 15/02
2017/0051949 A1 * 2/2017 Uselton ..... F25B 9/10
2017/0159977 A1 * 6/2017 Hellmann ..... F25B 1/10
2017/0205120 A1 * 7/2017 Ali ..... F25B 5/02
2019/0072305 A1 * 3/2019 Zha ..... F25B 41/04
2019/0086130 A1 * 3/2019 Hellmann ..... F25B 1/10
2019/0203980 A1 * 7/2019 Cavalleri ..... F25B 1/10
2019/0203993 A1 * 7/2019 Lesmerises ..... F25B 1/10
2019/0226723 A1 * 7/2019 Heyl ..... F25B 5/02
2019/0264933 A1 * 8/2019 Ignatiev ..... F25B 1/10
2019/0301772 A1 * 10/2019 Zha ..... F25B 41/04
2019/0368786 A1 * 12/2019 Newel ..... F25B 40/02

FOREIGN PATENT DOCUMENTS

WO 2011049767 A2 4/2011
WO 2011049767 A3 4/2011
WO 2014097484 A1 6/2014

* cited by examiner

COOLING SYSTEM

TECHNICAL FIELD

This disclosure relates generally to a cooling system, such as a refrigeration system.

BACKGROUND

Cooling systems are used to cool spaces, such as residential dwellings, commercial buildings, and/or refrigeration units. These systems cycle a refrigerant (also referred to as charge) that is used to cool the spaces.

SUMMARY OF THE DISCLOSURE

This disclosure contemplates an unconventional cooling system that uses an auxiliary cooling system to remove heat from a refrigerant during a power outage. The system directs refrigerant from a flash tank to an auxiliary cooling system during a power outage. The auxiliary cooling system removes heat from the refrigerant and directs the refrigerant back to the flash tank. In this manner, refrigerant in the cooling system is kept cool during a power outage, which reduces the amount of refrigerant lost from the system during the power outage in some embodiments. As a result, less maintenance needs to be performed on the system after the power outage. Certain embodiments of the system will be described below.

According to an embodiment, an apparatus includes a high side heat exchanger, a flash tank, a first load, a first compressor, an auxiliary cooling system, and a first check valve. The high side heat exchanger removes heat from a refrigerant. The flash tank stores the refrigerant from the high side heat exchanger. The first load uses the refrigerant to remove heat from a space proximate the first load. The first compressor compresses the refrigerant from the first load. The auxiliary cooling system removes heat from the refrigerant stored in the flash tank during a power outage. The first check valve directs the refrigerant between the first load and the first compressor back to the flash tank when the pressure of the refrigerant between the first load and the first compressor exceeds a threshold during the power outage.

According to another embodiment, a method includes removing, by a high side heat exchanger, heat from a refrigerant and storing, by a flash tank, the refrigerant from the high side heat exchanger. The method also includes using, by a first load, the refrigerant to remove heat from a space proximate the first load and compressing, by a first compressor, the refrigerant from the first load. The method further includes removing, by an auxiliary cooling system, heat from the refrigerant stored in the flash tank during a power outage and directing, by a first check valve, refrigerant between the first load and the first compressor back to the flash tank when the pressure of the refrigerant between the first load and the first compressor exceeds a threshold during the power outage.

According to yet another embodiment, a system includes a high side heat exchanger, a flash tank, a first load, a first compressor, an auxiliary heat exchanger, an auxiliary compressor, an auxiliary high side heat exchanger, an auxiliary generator, and a first check valve. The high side heat exchanger removes heat from a first refrigerant. The flash tank stores the first refrigerant from the high side heat exchanger. The first load uses the first refrigerant to remove heat from a space proximate the first load. The first compressor compresses the first refrigerant from the first load.

The auxiliary heat exchanger transfers heat from the first refrigerant stored in the flash tank to a second refrigerant during a power outage. The auxiliary compressor compresses the second refrigerant. The auxiliary high side heat exchanger removes heat from the second refrigerant. The auxiliary generator powers the auxiliary compressor during the power outage. The first check valve directs the first refrigerant between the first load and the first compressor back to the flash tank when the pressure of the first refrigerant between the first load and the first compressor exceeds a threshold during the power outage.

Certain embodiments provide one or more technical advantages. For example, an embodiment reduces the amount of refrigerant lost from a cooling system during a power outage. As another example, an embodiment reduces the amount of maintenance needed on a cooling system after a power outage. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
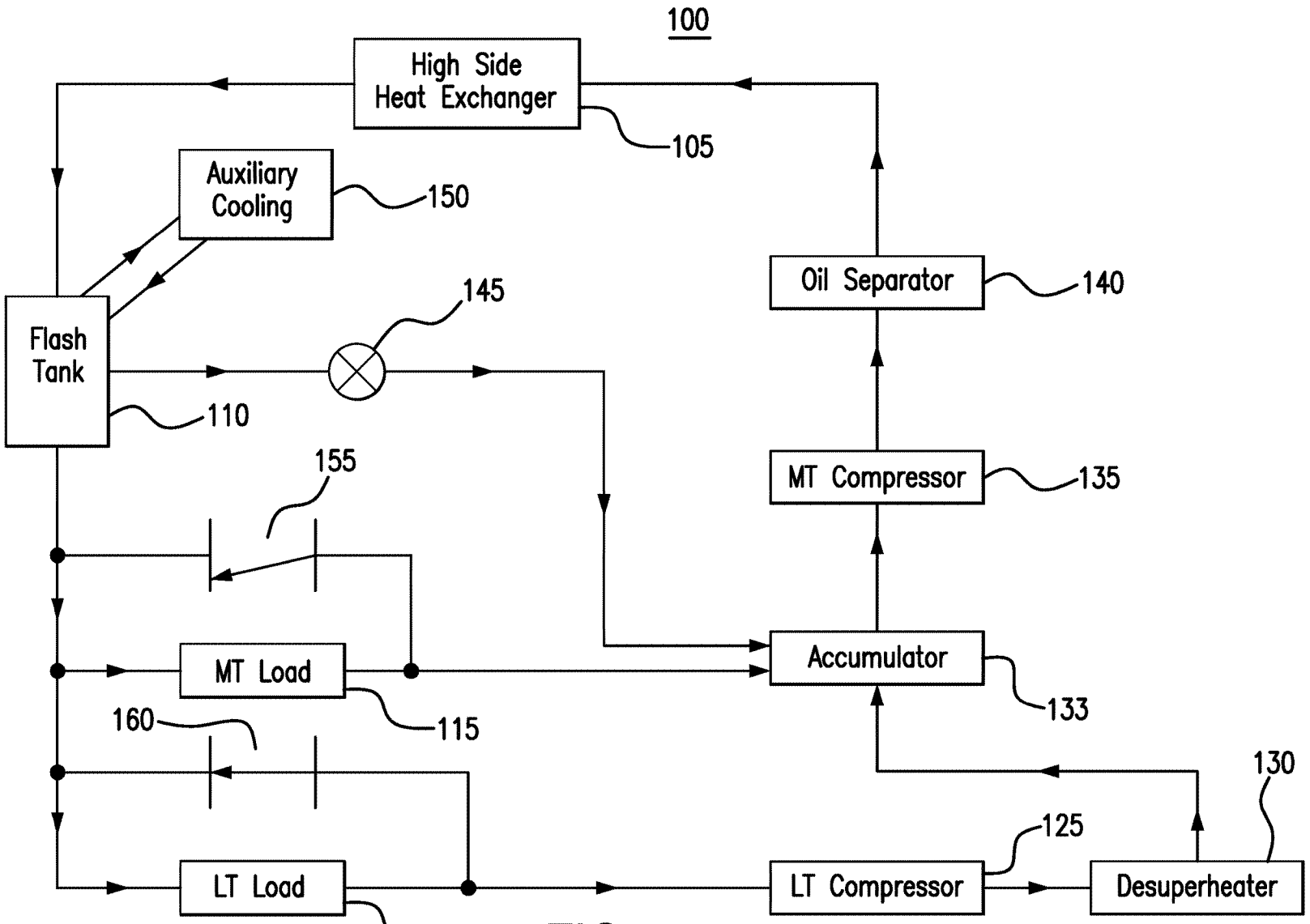
FIG. 1 illustrates an example cooling system.
Figure 2:
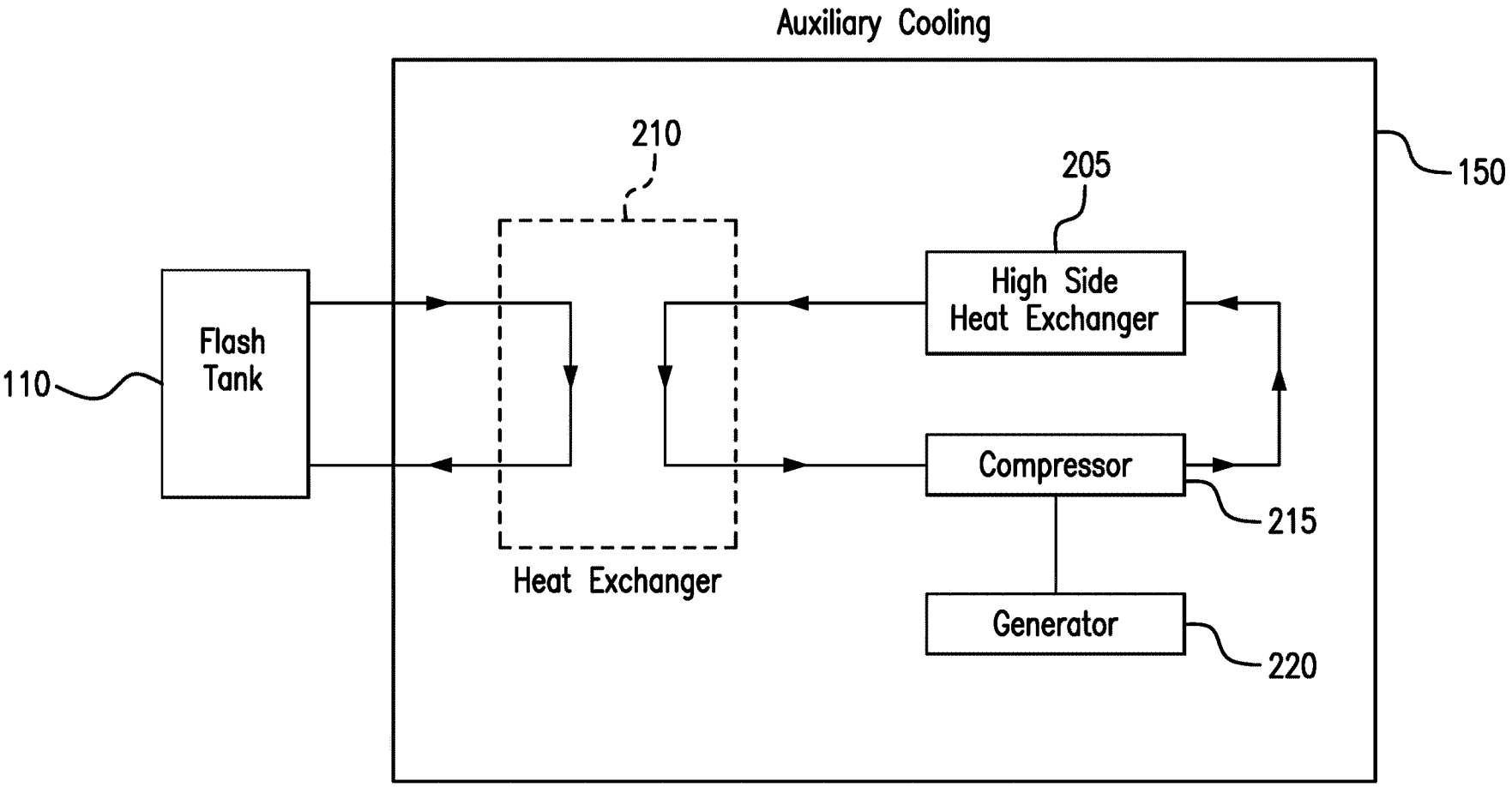
FIG. 2 illustrates a portion of the cooling system of FIG. 1.
Figure 3:
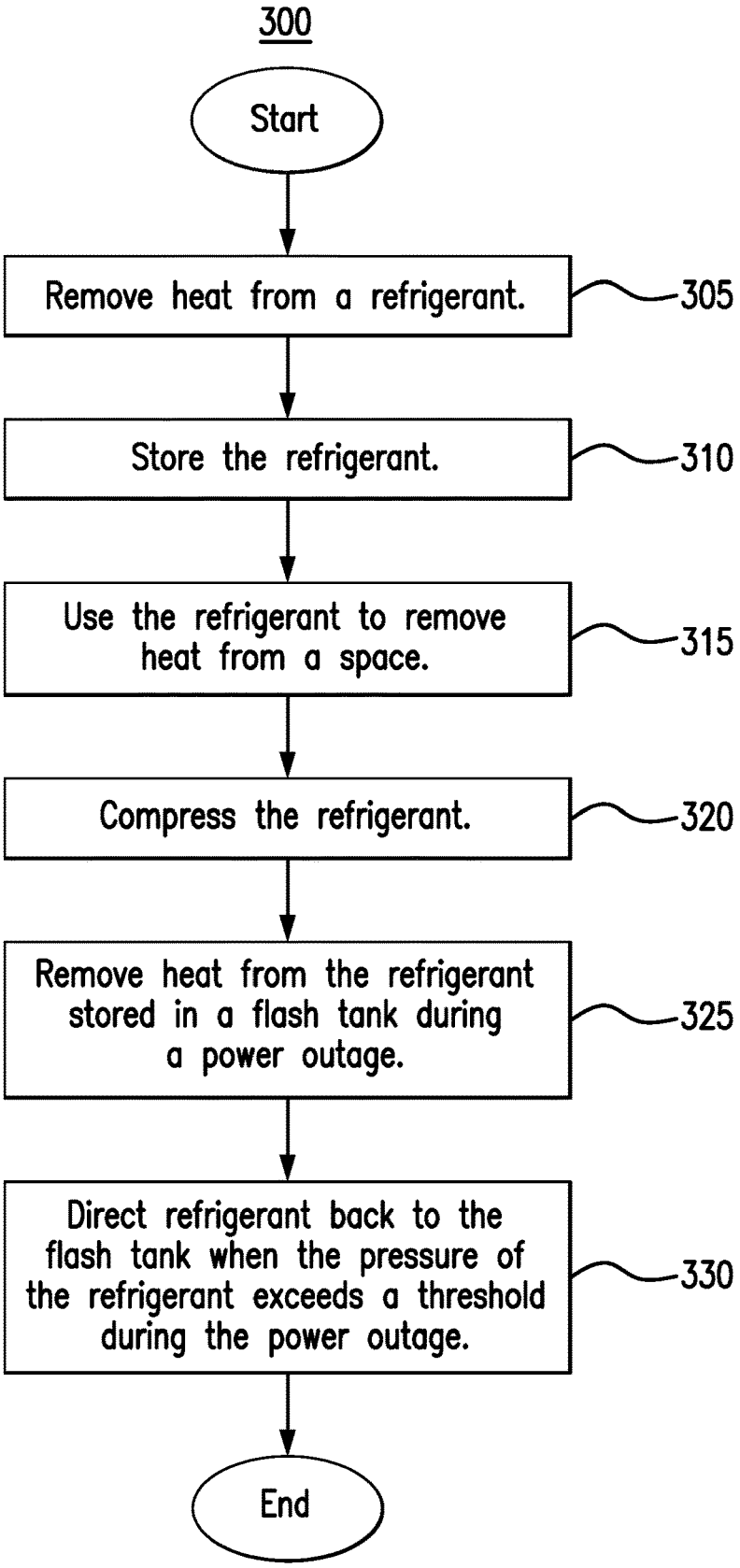
FIG. 3 is a flowchart illustrating a method for operating the cooling system of FIG. 1.

Embodiments of the present disclosure and its advantages are best understood by referring to FIGS. 1 through 3 of the drawings, like numerals being used for like and corresponding parts of the various drawings.

Cooling systems are used to cool spaces, such as residential dwellings, commercial buildings, and/or refrigeration units. These systems cycle a refrigerant (e.g., a carbon dioxide refrigerant) that is used to cool the spaces. In existing refrigeration systems, such as ones in grocery stores, refrigerant is cycled through various cooling cases to keep food cold. Generally, these refrigeration systems use two types of loads known as medium temperature loads and low temperature loads. The medium temperature loads may be produce shelves that keep a space cooled above freezing temperatures (e.g., above 32 degrees Fahrenheit), and the low temperature loads may be freezer cases that keep a space cooled below freezing temperatures (e.g., at or below 32 degrees Fahrenheit).

During a power outage, the refrigerant in the cooling system stops flowing and begins to absorb heat from the environment. Because the cooling system stops removing the heat from the refrigerant, the refrigerant becomes warmer and its pressure increases until the pressure trips a release valve, which causes the refrigerant to be released from the system. In some instances, enough refrigerant is lost from the system during the power outage that maintenance needs to be performed after the power outage to replenish the refrigerant in the system before the system can function normally.

This disclosure contemplates an unconventional cooling system that uses an auxiliary cooling system to remove heat from a refrigerant during a power outage. The system directs refrigerant from a flash tank to an auxiliary cooling system during a power outage. The auxiliary cooling system removes heat from the refrigerant and directs the refrigerant back to the flash tank. In this manner, refrigerant in the cooling system is kept cool during a power outage, which reduces the amount of refrigerant lost from the system during the power outage in some embodiments. As a result, less maintenance needs to be performed on the system after the power outage. The cooling system will be described in more detail using FIGS. 1 through 3.

FIG. 1 illustrates an example cooling system 100. As shown in FIG. 1, cooling system 100 includes a high side heat exchanger 105, a flash tank 110, a medium temperature load 115, a low temperature load 120, a low temperature compressor 125, a de-super heater 130, a medium temperature compressor 135, an oil separator 140, a bypass valve 145, an auxiliary cooling system 150, a check valve 155, and a check valve 160. In certain embodiments, auxiliary cooling system 150 removes heat from a refrigerant in cooling system 100 during a power outage so that the refrigerant is not lost from system 100 during the power outage.

High side heat exchanger 105 removes heat from a refrigerant. When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools gaseous and/or supercritical refrigerant and the refrigerant remains a gas and/or a supercritical fluid. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Flash tank 110 stores refrigerant received from high side heat exchanger 105. This disclosure contemplates flash tank 110 storing refrigerant in any state such as, for example, a liquid state and/or a gaseous state. Refrigerant leaving flash tank 110 is fed to low temperature load 120 and medium temperature load 115. In some embodiments, a flash gas and/or a gaseous refrigerant is released from flash tank 110. By releasing flash gas, the pressure within flash tank 110 may be reduced.

System 100 may include a low temperature portion and a medium temperature portion. The low temperature portion typically operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. As seen in FIG. 1, system 100 includes a medium temperature load 115 and a low temperature load 120. Each of these loads is used to cool a particular space. For example, medium temperature load 115 may be a produce shelf in a grocery store and low temperature load 120 may be a freezer case. Generally, low temperature load 120 keeps a space cooled to freezing temperatures (e.g., below 32 degrees Fahrenheit) and medium temperature load 115 keeps a space cooled above freezing temperatures (e.g., above 32 degrees Fahrenheit).

Refrigerant flows from flash tank 110 to both the low temperature and medium temperature portions of the refrigeration system. For example, the refrigerant may flow to low temperature load 120 and medium temperature load 115. When the refrigerant reaches low temperature load 120 or medium temperature load 115, the refrigerant removes heat from the air around low temperature load 120 or medium temperature load 115. As a result, the air is cooled. The cooled air may then be circulated such as, for example, by a fan to cool a space such as, for example, a freezer and/or a refrigerated shelf. As refrigerant passes through low temperature load 120 and medium temperature load 115, the refrigerant may change from a liquid state to a gaseous state as it absorbs heat.

Refrigerant flows from low temperature load 120 and medium temperature load 115 to compressors 125 and 135. This disclosure contemplates system 100 including any number of low temperature compressors 125 and medium temperature compressors 135. The low temperature compressor 125 and medium temperature compressor 135 may be configured to increase the pressure of the refrigerant. As a result, the heat in the refrigerant may become concentrated and the refrigerant may become a high-pressure gas. Low temperature compressor 125 compresses refrigerant from low temperature load 120 and sends the compressed refrigerant to medium temperature compressor 135 or to desuperheater 130. Medium temperature compressor 135 compresses refrigerant from low temperature compressor 125, desuperheater 130, and/or medium temperature load 115. The refrigerant from low temperature compressor 125 mixes with and is cooled by the refrigerant from medium temperature load 115 before entering medium temperature compressor 135. Medium temperature compressor 135 may then send the compressed refrigerant to high side heat exchanger 105 or oil separator 140.

Desuperheater 130 is an optional component within system 100. Desuperheater 130 removes heat from the refrigerant compressed by low temperature compressor 125 before that refrigerant reaches medium temperature compressor 135. By removing heat from that refrigerant, desuperheater 130 allows medium temperature compressor 135 to operate more efficiently and effectively. In embodiments where desuperheater 130 is not present, the compressed refrigerant from low temperature compressor 125 is sent directly to medium temperature compressor 135.

Accumulator 130 is an optional component within system 100. Accumulator 130 can accumulate and separate liquid refrigerant from vapor refrigerant coming from medium temperature load 115 and only allow vapor refrigerant to reach medium temperature compressor 135. In this manner, liquid refrigerant may be prevented from entering medium temperature compressor 135, which improves the operation of and maintains the condition of medium temperature compressor 135. In embodiments where accumulator 130 is not present, refrigerant from medium temperature load 115 is sent directly to medium temperature compressor 135.

Oil separator 140 is another component within system 100. Oil separator 140 removes any dissolved oils from the refrigerant leaving medium temperature compressor 135 before that refrigerant is received at high side heat exchanger 105. By removing the oil from the refrigerant, that oil is prevented from clogging other components of system 100 as the refrigerant flows through system 100, which maintains the efficiency and operation of system 100. The removed oil can be collected and put back into one or more of compressors 125 and 135.

Bypass valve 145 controls the flow of gaseous refrigerant (e.g., a flash gas) from flash tank 110 to medium temperature compressor 135. By opening valve 145, the gaseous refrigerant is allowed to leave flash tank 110 and flow to medium temperature compressor 135. Closing valve 145 prevents the gaseous refrigerant from flowing from flash tank 110 to medium temperature compressor 135. By allowing gaseous refrigerant to leave flash tank 110, the pressure within flash tank 110 and the pressure at medium temperature compressor 135 can be regulated.

During a power outage one or more components of system 100 cease to operate. For example, low temperature compressor 125 and medium temperature compressor 135 may stop compressing the refrigerant in system 100. As a result, the refrigerant in system 100 stops flowing and heat in the refrigerant is not removed. Additionally, during the power outage the refrigerant in the system continues absorbing heat from the environment around cooling system 100 and the refrigerant grows warmer. As the refrigerant grows warmer, its pressure increases. Because the heat in the refrigerant is not removed during the power outage, the pressure of the refrigerant will increase until a pressure release valve is tripped. When the pressure release valve is tripped, the refrigerant in system 100 is released into the environment and lost from system 100. In some instances, enough refrigerant is lost during the power outage that maintenance needs to be performed after the power outage to replenish the refrigerant in system 100.

This disclosure contemplates auxiliary cooling system 150 removing the heat from the refrigerant in system 100 during a power outage. For example, auxiliary cooling system 150 may transfer heat from the refrigerant in system 100 to a second refrigerant in auxiliary cooling system 150. Auxiliary cooling system 150 then removes the heat from the second refrigerant. In some embodiments, auxiliary cooling system 150 is powered by an auxiliary generator during the power outage. In this manner, heat from the refrigerant in system 100 is removed during the power outage which maintains and/or reduces the pressures of the refrigerant such that the pressure release valve does not trip in some embodiments. As a result, less refrigerant is lost during the power outage and less maintenance may be required after the power outage. In some installations, auxiliary cooling system 150 can cycle through the refrigerant in system 100 in about half an hour and pull down the temperature of the refrigerant in flash tank 110. Auxiliary cooling system 150 will be described in more detail using FIG. 2.

Check valve 155 directs refrigerant between medium temperature load 115 and medium temperature compressor 135 back to flash tank 110 when the pressure of that refrigerant exceeds a threshold during a power outage. Check valve 160 directs refrigerant between low temperature load 120 and low temperature compressor 125 back to flash tank 110 when the pressure of that refrigerant exceeds a threshold during the power outage. Each of check valves 155 and 160 can be configured to open when the pressure of the refrigerant between the loads 115 and 120 and compressors 125 and 135 exceeds certain thresholds. In some embodiments, these thresholds are set below the pressure at which the pressure release valve trips. As a result, the refrigerant is directed back to flash tank 110 so that it can be cooled by auxiliary cooling system 150 before the refrigerant pressure trips the pressure release valve. As a result, the amount of refrigerant in system 100 is maintained during the power outage.

FIG. 2 illustrates a portion of the cooling system 100 of FIG. 1. As shown in FIG. 2, system 100 includes a flash tank 110 and an auxiliary cooling system 150. Auxiliary cooling system 150 includes an auxiliary high side heat exchanger 205, a heat exchanger 210, an auxiliary compressor 215, and an auxiliary generator 220. In particular embodiments, auxiliary cooling system 150 removes heat from a refrigerant from flash tank 110 and transfers that heat to a second refrigerant circulated in auxiliary cooling system 150.

Auxiliary high side heat exchanger 205 removes heat from the second refrigerant circulated in auxiliary cooling system 150. When heat is removed from the second refrigerant, the second refrigerant is cooled. This disclosure contemplates auxiliary high side heat exchanger 125 being operated as a condenser and/or a gas cooler. When operating as a condenser, high side heat exchanger 205 cools the refrigerant such that the state of the refrigerant changes from a gas to a liquid. When operating as a gas cooler, high side heat exchanger 205 cools gaseous and/or supercritical refrigerant and the refrigerant remains a gas and/or a supercritical fluid. In certain configurations, high side heat exchanger 205 is positioned such that heat removed from the refrigerant may be discharged into the air. For example, high side heat exchanger 205 may be positioned on a rooftop so that heat removed from the refrigerant may be discharged into the air. As another example, high side heat exchanger 205 may be positioned external to a building and/or on the side of a building.

Heat exchanger 210 transfers heat from the refrigerant from flash tank 110 to the second refrigerant circulated in auxiliary cooling system 150. In certain embodiments, heat exchanger 210 is a plate heat exchanger. Refrigerant from flash tank 110 enters heat exchanger 210 during a power outage. Heat exchanger 210 transfers heat from the refrigerant from flash tank 110 into the second refrigerant circulated in auxiliary cooling system 150. As a result, the refrigerant from flash tank 110 cools. As that refrigerant cools, its pressure decreases. In some embodiments, heat exchanger 210 lowers the pressure of the refrigerant from flash tank 110 such that a pressure release valve in system 100 does not trip during a power outage.

Auxiliary compressor 215 compresses the second refrigerant circulated in auxiliary cooling system 150. Compressor 215 may be configured to increase the pressure of the second refrigerant. As a result, the heat in the second refrigerant may become concentrated and the second refrigerant may become a high-pressure gas. Compressor 215 may then send the compressed refrigerant to high side heat exchanger 205.

Auxiliary generator 220 powers auxiliary compressor 215 during a power outage. Generator 220 may be any suitable generator such as, for example, a gas or solar generator. By providing power to auxiliary compressor 215, the second refrigerant is allowed to circulate in auxiliary cooling system 150 during a power outage. In this manner, the second refrigerant is capable of removing heat from the refrigerant from flash tank 110. That heat is then dispelled by auxiliary high side heat exchanger 205.

In certain embodiments, by removing heat from the refrigerant from flash tank 110, auxiliary cooling system 150 lowers the pressure of the refrigerant in system 100 during a power outage. As a result, the refrigerant is not lost through a pressure release valve. Additionally, less maintenance is required after the power outage to replenish the refrigerant in system 100.

FIG. 3 is a flowchart illustrating a method 300 for operating the cooling system 100 of FIG. 1. In particular embodiments, various components of system 100 perform the steps of method 300. By performing method 300, the amount of refrigerant lost during a power outage is reduced. Additionally, less maintenance is required to replenish the refrigerant after the power outage.

A high side heat exchanger may begin method 300 by removing heat from a refrigerant in step 305. In step 310, a flash tank stores the refrigerant. A load then uses the refrigerant to remove heat from the space in step 315. In step 320, a compressor compresses the refrigerant.

After a power outage occurs, the refrigerant in the system may begin absorbing heat from the environment and its pressure may increase. In step 325, an auxiliary cooling system removes heat from the refrigerant stored in the flash tank during the power outage. The auxiliary cooling system may include a second refrigerant that absorbs the heat from the refrigerant in the cooling system. The heat in the second refrigerant is then removed from the second refrigerant. The auxiliary cooling system may be powered by a generator. In step 330, a check valve directs refrigerant back to the flash tank when the pressure of the refrigerant exceeds a threshold during the power outage. The check valve may be located between the load and the compressor. The threshold may be set such that it is below the pressure threshold of a pressure release valve. In this manner, the check valve directs the refrigerant back to the flash tank for auxiliary cooling before the pressure of the refrigerant trips the pressure release valve and the refrigerant is lost.

Modifications, additions, or omissions may be made to method 300 depicted in FIG. 3. Method 300 may include more, fewer, or other steps. For example, steps may be performed in parallel or in any suitable order. While discussed as system 100 (or components thereof) performing the steps, any suitable component of system 100 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a high side heat exchanger configured to remove heat from a refrigerant;

a flash tank configured to store the refrigerant from the high side heat exchanger;

a first load configured to use the refrigerant to remove heat from a space proximate the first load;

a first compressor configured to compress the refrigerant from the first load;

an auxiliary cooling system configured to remove heat from the refrigerant stored in the flash tank during a power outage; and a first check valve with an inlet that is downstream of the first load during a non-defrosting operation wherein the first check valve directs, when the pressure of the refrigerant between the first load and the first compressor exceeds a threshold during the power outage, the refrigerant between the first load and the first compressor back to the flash tank before the refrigerant reaches the high side heat exchanger.

2. The apparatus of claim 1, further comprising:

a second load configured to use the refrigerant to remove heat from a second space proximate the second load;

a second compressor configured to compress the refrigerant from the second load, the first compressor further configured to compress the refrigerant from the second compressor; and a second check valve that directs, when the pressure of the refrigerant between the second load and the second compressor exceeds a threshold during the power outage, the refrigerant between the second load and the second compressor back to the flash tank before the refrigerant reaches the high side heat exchanger.

3. The apparatus of claim 2, further comprising a desuperheater configured to remove heat from the refrigerant from the second compressor.

4. The apparatus of claim 1, further comprising a bypass valve configured to pass a flash gas from the flash tank to the first compressor.

5. The apparatus of claim 1, further comprising an oil separator configured to remove an oil from the refrigerant from the first compressor.

6. The apparatus of claim 1, wherein the auxiliary cooling system comprises a heat exchanger configured to transfer heat from the refrigerant to a second refrigerant.

7. The apparatus of claim 1, further comprising an accumulator configured to convert the refrigerant from a liquid to a gas before the refrigerant enters the first compressor.

8. A method comprising:

removing, by a high side heat exchanger, heat from a refrigerant;

storing, by a flash tank, the refrigerant from the high side heat exchanger;

using, by a first load, the refrigerant to remove heat from a space proximate the first load;

compressing, by a first compressor, the refrigerant from the first load;

removing, by an auxiliary cooling system, heat from the refrigerant stored in the flash tank during a power outage; and in response to the pressure of the refrigerant between the first load and the first compressor exceeding a threshold during the power outage, directing, by a first check valve, refrigerant between the first load and the first compressor back to the flash tank before the refrigerant reaches the high side heat exchanger, wherein the first check valve comprises an inlet that is downstream of the first load during a non-defrosting operation.

9. The method of claim 8, further comprising:

using, by a second load, the refrigerant to remove heat from a second space proximate the second load;

compressing, by a second compressor, the refrigerant from the second load;

compressing, by the first compressor, the refrigerant from the second compressor; and in response to the pressure of the refrigerant between the second load and the second compressor exceeding a threshold during the power outage, directing, by a second check valve, the refrigerant between the second load and the second compressor back to the flash tank before the refrigerant reaches the high side heat exchanger.

10. The method of claim 9, further comprising removing, by a desuperheater, heat from the refrigerant from the second compressor.

11. The method of claim 8, further comprising passing, by a bypass valve, a flash gas from the flash tank to the first compressor.

12. The method of claim 8, further comprising removing, by an oil separator, an oil from the refrigerant from the first compressor.

13. The method of claim 8, further comprising transferring, by a heat exchanger of the auxiliary cooling system, heat from the refrigerant to a second refrigerant.

14. The method of claim 8, further comprising converting, by an accumulator, the refrigerant from a liquid to a gas before the refrigerant enters the first compressor.

15. A system comprising:

a high side heat exchanger configured to remove heat from a first refrigerant;

a flash tank configured to store the first refrigerant from the high side heat exchanger;

a first load configured to use the first refrigerant to remove heat from a space proximate the first load;

a first compressor configured to compress the first refrigerant from the first load;

an auxiliary heat exchanger configured to transfer heat from the first refrigerant stored in the flash tank to a second refrigerant during a power outage;

an auxiliary compressor configured to compress the second refrigerant;

an auxiliary high side heat exchanger configured to remove heat from the second refrigerant;

an auxiliary generator configured to power the auxiliary compressor during the power outage; and a first check valve with an inlet that is downstream of the first load during a non-defrosting operation wherein the first check valve directs, when the pressure of the first refrigerant between the first load and the first compressor exceeds a threshold during the power outage, the first refrigerant between the first load and the first compressor back to the flash tank before the refrigerant reaches the high side heat exchanger.

16. The system of claim 15, further comprising:

a second load configured to use the first refrigerant to remove heat from a second space proximate the second load;

a second compressor configured to compress the first refrigerant from the second load, the first compressor further configured to compress the first refrigerant from the second compressor; and a second check valve that directs, when the pressure of the first refrigerant between the second load and the second compressor exceeds a threshold during the power outage, the first refrigerant between the second load and the second compressor back to the flash tank before the refrigerant reaches the high side heat exchanger.

17. The system of claim 16, further comprising a desuperheater configured to remove heat from the first refrigerant from the second compressor.

18. The system of claim 15, further comprising a bypass valve configured to pass a flash gas from the flash tank to the first compressor.

19. The system of claim 15, further comprising an oil separator configured to remove an oil from the first refrigerant from the first compressor.

20. The system of claim 15, wherein the auxiliary heat exchanger is a plate heat exchanger.

21. The system of claim 15, further comprising an accumulator configured to convert the first refrigerant from a liquid to a gas before the first refrigerant enters the first compressor.

* * * * *